US007006778B2

(12) United States Patent
Mitchell et al.

(10) Patent No.: US 7,006,778 B2
(45) Date of Patent: Feb. 28, 2006

(54) DETONING APPARATUS AND METHOD

(75) Inventors: Harold S. Mitchell, Webster, NY (US); Claude R. Colleyacme, Webster, NY (US); Richard S. Held, Marion, NY (US); Rudolph Forgensi, Webster, NY (US)

(73) Assignee: Xerox Corporation, Stamford, CT (US)

( * ) Notice: Subject to any disclaimer, the term of this patent is extended or adjusted under 35 U.S.C. 154(b) by 91 days.

(21) Appl. No.: 10/736,412

(22) Filed: Dec. 15, 2003

(65) Prior Publication Data

US 2004/0126141 A1 Jul. 1, 2004

Related U.S. Application Data

(60) Provisional application No. 60/434,196, filed on Dec. 17, 2002.

(51) Int. Cl.
*G03G 15/08* (2006.01)
*G03G 15/06* (2006.01)

(52) U.S. Cl. ..... 399/253; 399/222

(58) Field of Classification Search ..... 399/93, 399/98, 99, 222, 358, 359, 252, 253, 259; 209/509, 9; 430/105, 120, 122, 125, 106.1, 430/137.1

See application file for complete search history.

(56) References Cited

U.S. PATENT DOCUMENTS

| | | | | | |
|---|---|---|---|---|---|
| 3,572,501 | A | * | 3/1971 | Brennan | 209/9 |
| 3,623,453 | A | * | 11/1971 | Seimiya et al. | 118/309 |
| 3,799,113 | A | * | 3/1974 | Whited | 430/120 X |
| 4,500,194 | A | * | 2/1985 | Knott | 399/253 |
| 4,511,639 | A | * | 4/1985 | Knott et al. | 430/137.1 X |
| 5,237,371 | A | * | 8/1993 | Hori | 399/253 X |

* cited by examiner

*Primary Examiner*—Sandra L. Brase

(57) ABSTRACT

A toner separation apparatus includes a target, an inlet through which toner laden carrier enters to strike the target, an exit for carrier particles below the target, and an exit for toner particles downstream of the target. A filter can be positioned between the target and the toner exit, and a mesh to which the target is attached can be located between the inlet and the filter. The toner-laden carrier can be entrained by air driven by one or more impellers, which can be located within or without the apparatus, upstream or downstream of the target.

19 Claims, 3 Drawing Sheets

DETONING APPARATUS AND METHOD

CROSS REFERENCE TO RELATED APPLICATIONS

This application claims priority to U.S. Provisional Patent Application No. 60/434,196, filed Dec. 17, 2002.

FIELD OF THE INVENTION

The invention relates to separation of electrostatically bound particles. In particular, for xerographic and other electroreprographic developers, the invention relates to the removal of toner particles from carrier particles.

BACKGROUND AND SUMMARY

Previous methods of detoning carrier involved passing toned carrier through a ceramic lined air classifier. This device was used for ferrite carrier detoning and was decommissioned several years ago then disposed. A need for a relatively inexpensive detoning apparatus has arisen to allow separation of toner from carrier in reclamation and other facilities.

Embodiments comprise a target and an inlet thmugh which toner laden carrier enters the apparatus and can strike the target. The target can be, for example, a 4" to 6" metal disc target offset 1" to 2" from the center of a screen filter. The apparatus also includes an exit through which detoned carrier passes and an exit through which separated toner passes. The carrier exit can be located below the target, whereas the detoned carrier will be located downstream of the target. This arrangement efficiently loosens toner attached to air entrained carrier, and at the same time protects the fine wire screen filter of the toner separation apparatus from direct impact of the high density carrier.

The apparatus can also include a filter downstream of the target through which toner can pass. The preferred filter medium is, for example, a woven fine wire cloth type. A mesh to which the target is attached can be located between the inlet and the filter and should be sized so that both toner and carrier can pass through the mesh. Preferably, the mesh is made from a rigid, heavy gauge sheet metal with large perforations.

The toner-laden carrier can be entrained by air driven by an impeller. The impeller can be located within the apparatus, upstream or downstream of the target. For heavier developers, embodiments can employ an air entrainment device to enable transport and efficient entrainment of the developer. For example, the impeller could be mounted in the inlet or in the toner exit. Alternatively, the impeller can be located external to the apparatus and be in fluid communication with the apparatus, such as in a duct or the like attached to the toner exit. In embodiments, a plurality of impellers can be employed in various locations to enhance flow of toner-laden carrier and the separated toner and carrier particles.

A feature of embodiments is the steep, up to 90 degree, angle to the incoming air entrained carrier stream and the offset from the screen surface which allows the approximately 1–20 micron toner to de-attach itself from the approximately 40–150 micron carrier and be carried in the air stream through the fine mesh screen filter (approximately 25 to 45 micron opening size). The offset of the target from the inlet allows the air flow stream patterns to efficiently entrain the loose toner through the screen filter while the carrier falls by gravity along the screen filter surface to a collection vessel.

The apparatus executes a detoning or toner separation method including providing a supply of toner laden carrier, providing a target, providing a filter, and providing an impeller. The method can further comprise providing a mesh to which the target is attached, and providing a filter through which the toner can pass, the filter being attached to the door. The mesh with the attached target is held in place by brackets attached to the inside of the conical door. The method can also include providing a sweeper bar that agitates material on the filter, which prevents the filter from clogging. Advantageously, the method can further include providing a carrier exit through which detoned carrier travels and/or providing a toner exit through which the separated toner passes.

Embodiments have been employed to detoned an incorrect toner (8% toner concentration, TC) from developer so that the carrier could be reclaimed and developer blended with the proper toner. The toner needed to be removed down to a 0.1% TC to assure against detrimental toner contamination. A slightly conical disc target was centered as a perpendicular impact target a short distance from the screen filter surface. The entire air entrained developer stream impacted the target. A single pass at high developer flow rate (approx. 500 lbs/hr) detoned the carrier to 0.4% TC from the starting 8% TC. With the target, over 10,000 lbs. was processed without screen damage. A second pass reduced the TC further to 0.1% TC (a low acceptable toner contamination TC).

DETAILED DESCRIPTION

Figure 1:
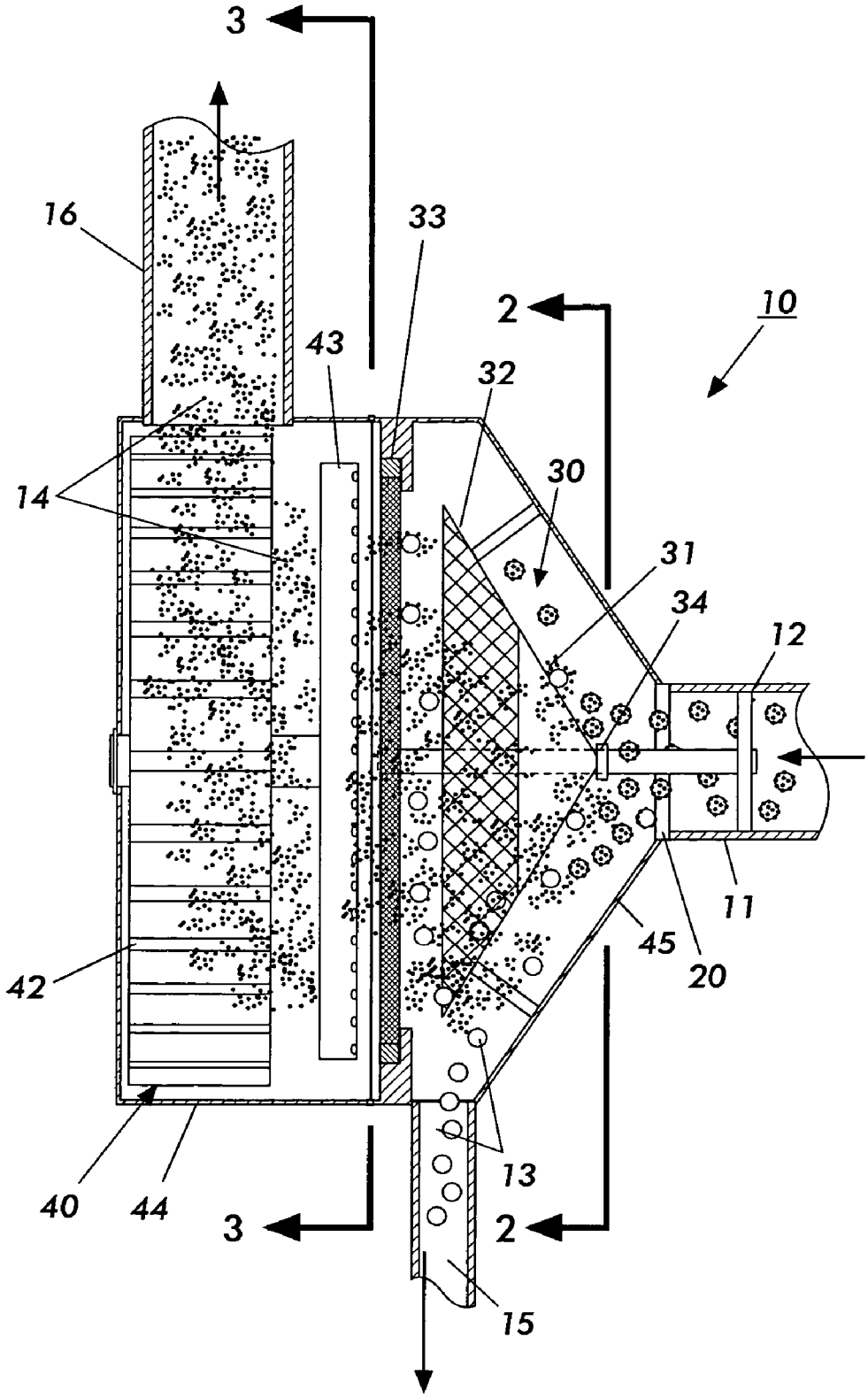
FIG. 1 is a schematic cross-section of embodiments.

For a general understanding of the present invention, reference is made to the drawings. In the drawings, like reference numerals have been used throughout to designate identical elements.

With reference to the accompanying FIGS., a screen filter 33 which is used as a toner separation apparatus 10 receives toner-laden carrier 12 and separates toner particles 14 from their respective carrier particles 13. In embodiments, the apparatus comprises, in a separation section 30, a target 31 and an inlet 20 through which toner laden carrier 12 enters the apparatus 10 and can strike the target 31. A supply line 11 brings the toner-laden carrier 12 from a supply. The target 31 can be, for example, a 4" to 6" metal disc target offset 1" to 2" from the center of the screen filter 33. In embodiments, a TURBOSCREEN® screen filter was used. The apparatus 10 also includes an exit 15 through which detoned carrier 13 passes and an exit 16 through which separated toner 14 passes. The detoned carrier exit 15 can be located below the target 31, whereas the toner exit 16 will be located downstream of the target 31. This arrangement efficiently loosens toner 14 attached to air entrained carrier, and at the same time protects the fine wire screen filter 33 from direct impact of the high density carrier. The filter 33 is preferably held in place by clips in a recess in the flange of door 45 and by bolt 34.

Figure 2:
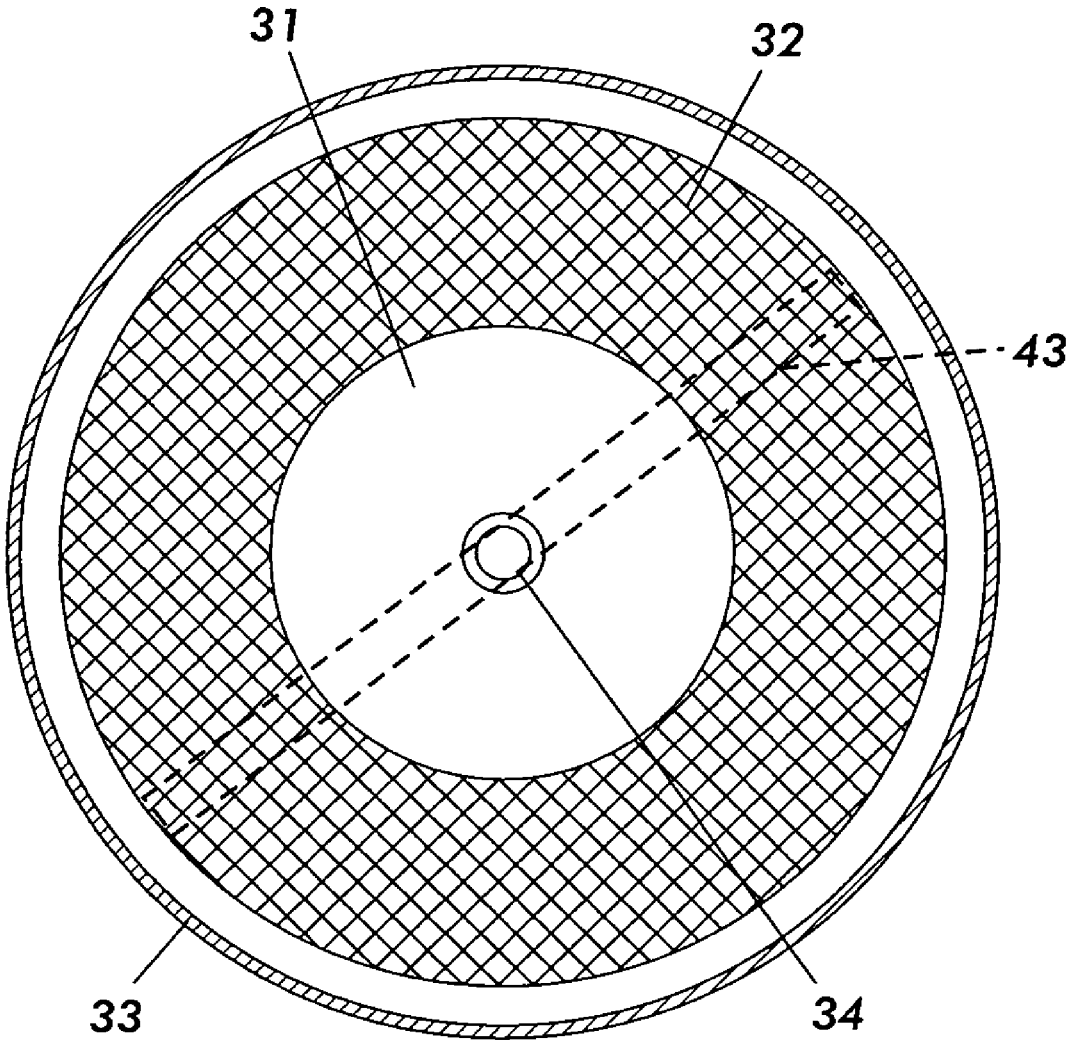
FIG. 2 is a schematic view of embodiments taken along line 2—2 in FIG. 1.

As seen particularly in FIG. 2, the apparatus 10 can also include a filter 33 downstream of the target through which toner 14 can pass. A mesh 32 to which the target 31 is attached can be located between the inlet 20 and the filter 33 and should be sized so that both toner 14 and carrier 13 can pass through the mesh.

Figure 3:
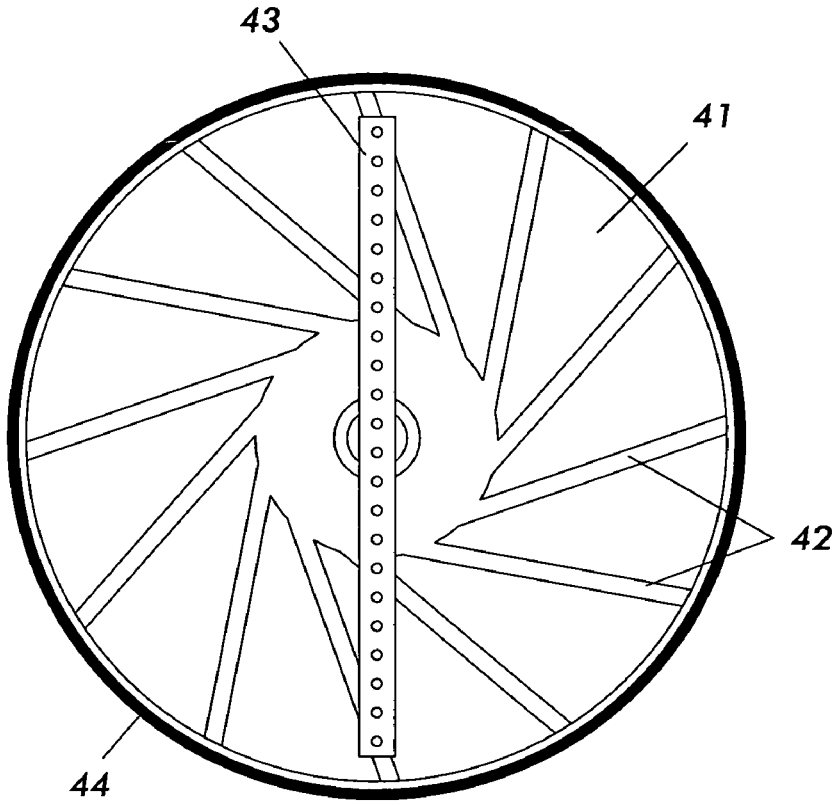
FIG. 3 is a schematic view of embodiments taken along line 3—3 in FIG. 1.
Figure 4:
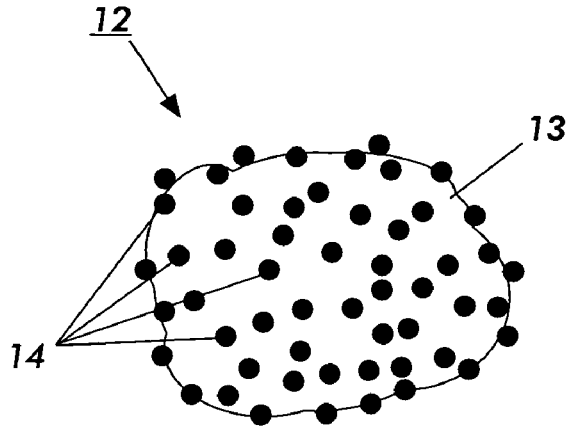
FIG. 4 is a schematic illustration of a toner-laden carrier particle (2 component developer particle) processed by embodiments.

The toner-laden carrier 12 can be entrained by air driven by an impeller 40. The impeller 40 can be located within the apparatus, upstream or downstream of the target. For example, the impeller could be mounted in the inlet or in the toner exit. Alternatively, the impeller can be located external to the apparatus and be in fluid communication with the apparatus, such as in a duct or the like attached to the toner exit. In embodiments, a plurality of impellers can be employed in various locations to enhance flow of toner-laden carrier and the separated toner and carrier particles. An example of an impeller 40 that can be used in embodiments is a centrifugal fan, shown schematically in FIGS. 1 and 3. Such an impeller 40 includes a backplate 41 on which are formed a plurality of vanes 42, preferably set inside a circular housing 44. Additionally, a sweeper bar 43 can be included that rotates with the impeller 40 and directs air jets at the filter 33 to dislodge accumulated toner particles 14.

A feature of embodiments is the steep, up to 90 degree, angle to the incoming air entrained carrier stream and the offset from the screen surface which allows the approximately 1–20 micron toner to de-attach itself from the approximately 40–150 micron carrier and be carried in the air stream through the fine mesh screen (approximately 25 to 45 micron opening size). The offset of the target from the inlet allows the air flow stream patterns to efficiently entrain the loose toner through the screen filter while the carrier falls by gravity along the screen filter surface to a collection vessel.

The apparatus executes a detoning or toner separation method including providing a supply of toner laden carrier, providing a target, providing a filter, and providing an impeller. The method can further comprise providing a mesh to which the target is attached, and providing a filter through which the toner can pass, the filter being attached to the mesh and the target by a bolt. The method can also include providing a sweeper bar that agitates material on the filter, which prevents the filter from clogging. Advantageously, the method can further include providing a carrier exit through which detoned carrier travels and/or providing a toner exit through which the separated toner passes.

As mentioned in the Background and Summary, embodiments have been employed to detoned an incorrect toner (8% TC) from developer so it could be reclaimed and developer blended with the proper toner. The toner needed to be removed down to a 0.1% TC to assure against detrimental toner contamination. A slightly conical disc target was centered as a perpendicular impact target a short distance from the screen filter surface. The entire air entrained developer stream impacted the target. A single pass at high developer flow rate (approx. 500 lbs/hr) detoned the carrier to 0.4% toner concentration (TC) from the starting 8% TC. A second pass reduced the TC further to 0.1% TC (a low acceptable toner contamination TC).

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A toner separation method comprising:

providing a supply of toner laden carrier;

providing a target that is struck by the supply of toner laden carrier;

providing a filter that filters the supply of toner laden carrier; and providing an impeller that transports the supply of toner laden carrier.

2. The method of claim 1 further comprising providing a mesh to which the target is attached.

3. The method of claim 1 further comprising providing a filter through which the toner can pass, the filter being attached to a recess of a door flange via clips and a bolt.

4. The method of claim 1 further comprising providing a sweeper bar that agitates material on the filter.

5. The method of claim 1 further comprising providing a carrier exit through which detoned carrier travels.

6. The method of claim 1 further comprising providing a toner exit through which the separated toner passes.

7. The method of claim 1 further comprising providing a carrier reservoir in fluid communication with the carrier exit.

8. The method of claim 1 further comprising providing a toner reservoir in fluid communication with the toner exit.

9. A toner separation apparatus comprising:

a target and an inlet through which toner laden carrier enters the apparatus and can strike the target;

a filter through which toner can pass;

an exit through which detoned carrier passes; and an exit through which separated toner passes.

10. The apparatus of claim 9 further comprising, a mesh to which the target is attached and through which both toner and carrier can pass.

11. The apparatus of claim 9 further comprising an impeller.

12. The apparatus of claim 11 wherein the impeller is located within the apparatus.

13. The apparatus of claim 11 wherein the impeller is located external to the apparatus and is in fluid communication with the apparatus.

14. The apparatus of claim 10 wherein there are a plurality of impellers.

15. The apparatus of claim 9 further comprising a carrier reservoir in fluid communication with the carrier exit.

16. The apparatus of claim 9 further comprising a toner reservoir in fluid communication with the toner exit.

17. A toner separation apparatus comprising:

a target and an inlet through which toner laden carrier enters the apparatus and can strike the target;

an exit through which detoned carrier passes; and an exit through which separated toner passes.

the apparatus executing a method comprising:

providing a supply of toner laden carrier;

providing a target that is struck by the supply of toner laden carrier;

providing a filter that filters the supply of toner laden carrier; and providing an Impeller that transports the supply of toner laden carrier.

18. The apparatus of claim 17 further comprising a carrier reservoir in fluid communication with the carrier exit.

19. The apparatus of claim 17 further comprising a toner reservoir in fluid communication with the toner exit.

* * * * *